US010011940B2

(12) United States Patent
Ayhaner et al.

(10) Patent No.: US 10,011,940 B2
(45) Date of Patent: Jul. 3, 2018

(54) HOUSEHOLD APPLIANCE FOR THE CARE OF LAUNDRY ITEMS WITH A DISPENSING TRAY AND A SUDS CONTAINER

(71) Applicant: BSH BOSCH UND SIEMENS HAUSGERÄTE GMBH, Munich (DE)

(72) Inventors: Alper Ayhaner, Berlin (DE); Edwin Bolduan, Berlin (DE); Kurt Richter, Falkensee (DE)

(73) Assignee: BSH Hausgeräte GmbH, München (DE)

( * ) Notice: Subject to any disclaimer, the term of this patent is extended or adjusted under 35 U.S.C. 154(b) by 275 days.

(21) Appl. No.: 14/367,664

(22) PCT Filed: Dec. 18, 2012

(86) PCT No.: PCT/EP2012/075874
§ 371 (c)(1),
(2) Date: Jun. 20, 2014

(87) PCT Pub. No.: WO2013/092540
PCT Pub. Date: Jun. 27, 2013

(65) Prior Publication Data

US 2015/0013396 A1 Jan. 15, 2015

(30) Foreign Application Priority Data

Dec. 21, 2011 (DE) ..... 10 2011 089 387

(51) Int. Cl.
*D06F 39/02* (2006.01)
*D06F 39/08* (2006.01)

(52) U.S. Cl.
CPC ..... *D06F 39/02* (2013.01); *D06F 39/088* (2013.01)

(58) Field of Classification Search
CPC ..... D06F 39/02
See application file for complete search history.

(56) References Cited

U.S. PATENT DOCUMENTS 5,588,313 A * 12/1996 Hildebrand ..... D06F 25/00 68/17 R
2009/0293202 A1* 12/2009 Bolduan ..... D06F 39/028 8/137

FOREIGN PATENT DOCUMENTS

CN 101622392 1/2010
DE 38 22 392 A1 4/1989
DE 10 2006 029953 1/2008
(Continued)

OTHER PUBLICATIONS

Machine Translation of DE102009029523 (Mar. 24, 2011).*
(Continued)

*Primary Examiner* — Spencer E Bell
(74) *Attorney, Agent, or Firm* — Nixon & Vanderhye, P.C.

(57) ABSTRACT

The invention relates to a household appliance (1) for the care of laundry items, with a dispensing tray (8*a*) and a suds container (2), which is connected to the dispensing tray (8*a*) via at least one supply duct (4*a*, 4*b*), wherein a vapour barrier device (17*a*, 17*b*) is formed in a curved line section (18*a*, 18*b*) in the supply duct (4*a*, 4*b*), wherein a ventilating channel (22) is formed in the line section (18*a*, 18*b*) and opens into a first end (19) of the line section (18*a*, 18*b*) and is separated at the first end (19) from a supply channel (21), associated with the vapour barrier device (17*a*, 17*b*), for supplying liquid medium from the dispensing tray (8*a*) to the suds container (2).

22 Claims, 3 Drawing Sheets

(56) References Cited

FOREIGN PATENT DOCUMENTS

| | | |
|---|---|---|
| DE | 10 2009 029523 | 3/2011 |
| EP | 2038468 | 3/2009 |

OTHER PUBLICATIONS

International Search Report for PCT/EP2012/075874, dated Jun. 27, 2013.
Foreign-language Written Opinion of the International Searching Authority for PCT/EP2012/075874, dated Jun. 27, 2013.
Decision on Granting dated Aug. 7, 2015 issued in Russian Application No. 2014128512/12(046175) (4 pages).

* cited by examiner

HOUSEHOLD APPLIANCE FOR THE CARE OF LAUNDRY ITEMS WITH A DISPENSING TRAY AND A SUDS CONTAINER

This application is a National Phase of International Application No. PCT/EP2012/075874, filed Dec. 18, 2012, which designed the U.S. and claims priority to DE Application No. 10 2011 089 387.3, filed on Dec. 21, 2011, the entire contents of each of which are hereby incorporated by reference.

The invention relates to a household appliance for the care of laundry items, with a dispensing tray and a suds container, which is connected to the dispensing tray via a supply duct, wherein a vapor barrier device is formed in a curved line section in the supply duct.

Known from DE 10 2006 029 953 A1 is a washing machine with a controllable fresh-water intake for at least two detergent chambers. A detergent dispensing mechanism is arranged in an upper region of the washing machine housing. Detergent supply lines open downward from an uneven floor of the housing of this detergent dispensing mechanism toward the inlet on a collar on the one hand and toward the inlet on a suds container on the other hand.

This detergent dispensing mechanism also provides ventilation for the suds container without an additional ventilation line and, due to the two separate detergent supply lines and their connection to the uneven floor of the housing of this detergent supply mechanism, it is always guaranteed that one of these two lines is unoccupied.

In addition, known from DE 10 2009 029 523 A1 is water-bearing household appliance with a water reservoir device. A first bent pipe section and a second bent pipe section, which are connected to each other, are arranged in a supply duct to a collar or a suds container of the household appliance. A suction lift formed by a suction lift channel is arranged in the interior at a distance to the two internal apertures of this complete connected pipe section. When fresh water is flushed through a water reservoir device, the fresh water flows through both the flow channel formed next to the suction lift channel and through the actual suction lift channel. When the fresh-water supply is interrupted, water is drawn out of the reservoir section via the suction lift channel until the water level reaches the reservoir level. The reservoir level lies below an overflow level from which water flows through the flow channel into the treatment region of the household appliance. The reservoir level is also below an inlet of the reservoir section. During a washing or drying process, the water reservoir device, filled with water up to the reservoir level in the reservoir section, forms a vapor barrier. This enables the escape of vapor from the suds container to be prevented during this process. Therefore, for the purposes of the invention, a vapor barrier is a substantially U-shaped pipe system, wherein the intercommunicating pipelines of the pipe system can be filled with a liquid medium to a level at which no gaseous media can escape. The vapor barrier is effective when the pipe system is filled to this level. The pipe system can also have a shape different from a U shape as long as the intercommunicating pipe lines can provide an equivalent vapor barrier of this kind It is the object of the present invention to provide a household appliance for the care of laundry items with which a compact structure achieves dispensing of liquid on the one hand and ventilation on the other.

This object is achieved by a household appliance as claimed in claim 1.

A household appliance for the care of laundry items according to the invention comprises a dispensing tray and a suds container, which is connected to the dispensing tray via at least one supply duct. The supply duct is used to feed in particular liquid medium, in particular detergent and water, to the collar or to the suds container. A vapor barrier device or a vapor barrier is formed in a curved line section in the supply duct. A ventilating channel, which opens into a first end of the line section, is formed in the line section. At the first end, this ventilating channel is separated from a supply channel associated with the vapor barrier device for supplying liquid medium from the dispensing tray to the suds container. This means a line section is formed with which both the ventilating channel and the supply channel open at a first end and these two channels are also still formed separately from each other at this first end. Hence, two different channels which are still embodied separately from each other are integrated in this line section in an extremely compact and space-saving embodiment. This also creates a line section with a connection at this first end comprising two channels. It is no longer necessary to connect two separate lines but, as it were, a connection is only established via this one first end. Hence, a line section is created with an integrated multiway system, wherein to this end a water feed system and an air channel system are implemented in one component. To this end, separate air and water passages are implemented at the front end. For this, a vapor barrier is formed in the water feed, which prevents steam or condensate escaping from a suds container. In addition, from a functional viewpoint, ventilation is achieved in the region of the cold water inflow into the dispensing tray by means of the hot process air. This effects temperature equalization and prevents the condensation of water. The escape of vapor from the filling mechanism formed by the suds container and the drum is effectively prevented.

It is preferably provided that, considered with respect to levels, the first end of the line section is an upper end. This enables the conceptual implementation of the vapor barrier, on the one hand, and the ventilation, on the other hand, to be achieved in a particularly reliable way and particularly simple connectivity to the dispensing tray is guaranteed.

It is preferably provided that the ventilating channel is formed so that it encircles the supply channel at the first end in some regions. The fact that no complete circle is formed also means a particularly mechanically stabile embodiment is implemented and particularly suitable positioning of the ventilating channel and of the supply channel is achieved. In particular, ventilation can then be embodied in a quite specific position at this first end and, on transition into a dispensing tray and an air vent channel present there, take place in a particularly targeted and also tight manner.

It is preferably provided that the ventilating channel opens into the supply channel at an opening point, wherein, considered with respect to levels, the opening point lies over a liquid level in the supply channel at which the vapor barrier is formed.

Hence, this opening point is formed at the end of this ventilating channel facing away from the first end of the line section and hence at a point offset inward in the line section.

It is preferably provided that, after the opening of the ventilating channel, the supply channel comprises a flexible channel section, in particular that this flexible channel section is formed as a corrugated tube. An embodiment of this kind enables an otherwise particularly rigidly formed line section or supply duct to experience a certain reversible deformability so that it does not experience any damage when the system moves during the operation of the household appliance.

It is preferably provided that the supply duct is formed as a one-piece component in the form of the actual line section, in particular as an injection-molded part.

This filler hose or this line section provides the connection from the filler arrangement with the dispensing tray and the detergent metering toward the suds container. At the same time, this line section is also responsible for transporting the process water into the suds container. Due to the dynamic movements of the washing unit or the vibrating system, the motion compensation for this line section is in particular provided by a flexible folded region or the aforementioned flexible channel section.

As a result of the quite specific embodiment of the line section, said line section simultaneously transports the heated process air to a condensation region in the dispensing arrangement. The special feature consists in the fact that the air guidance is integrated in the line section, but is transported via a channel course which is separate from the water passage. The water reservoir device provided makes transportation back via the water passage impossible. The free-flow cross section required for the air guidance is in particular achieved by an eccentric arrangement of a branch in the branch. This enables a particularly space-saving concept which establishes a simple connection principle which is also mechanically stable and robust.

The sealing of the internal and external connecting branches is advantageously achieved by specific sealing elements or sealing ribs. The hose connection can also be secured by suitable hose clamps on the external branch.

An exemplary embodiment of the invention is described in more detail below with reference to schematic drawings, in which:

In the figures, the same or functionally equivalent elements are provided with the same reference numbers.

FIG. 1 shows a washing machine, which is designed for the care of laundry items, as water-bearing household appliance 1. However, the household appliance 1 can also be a washer drier.

Figure 1:
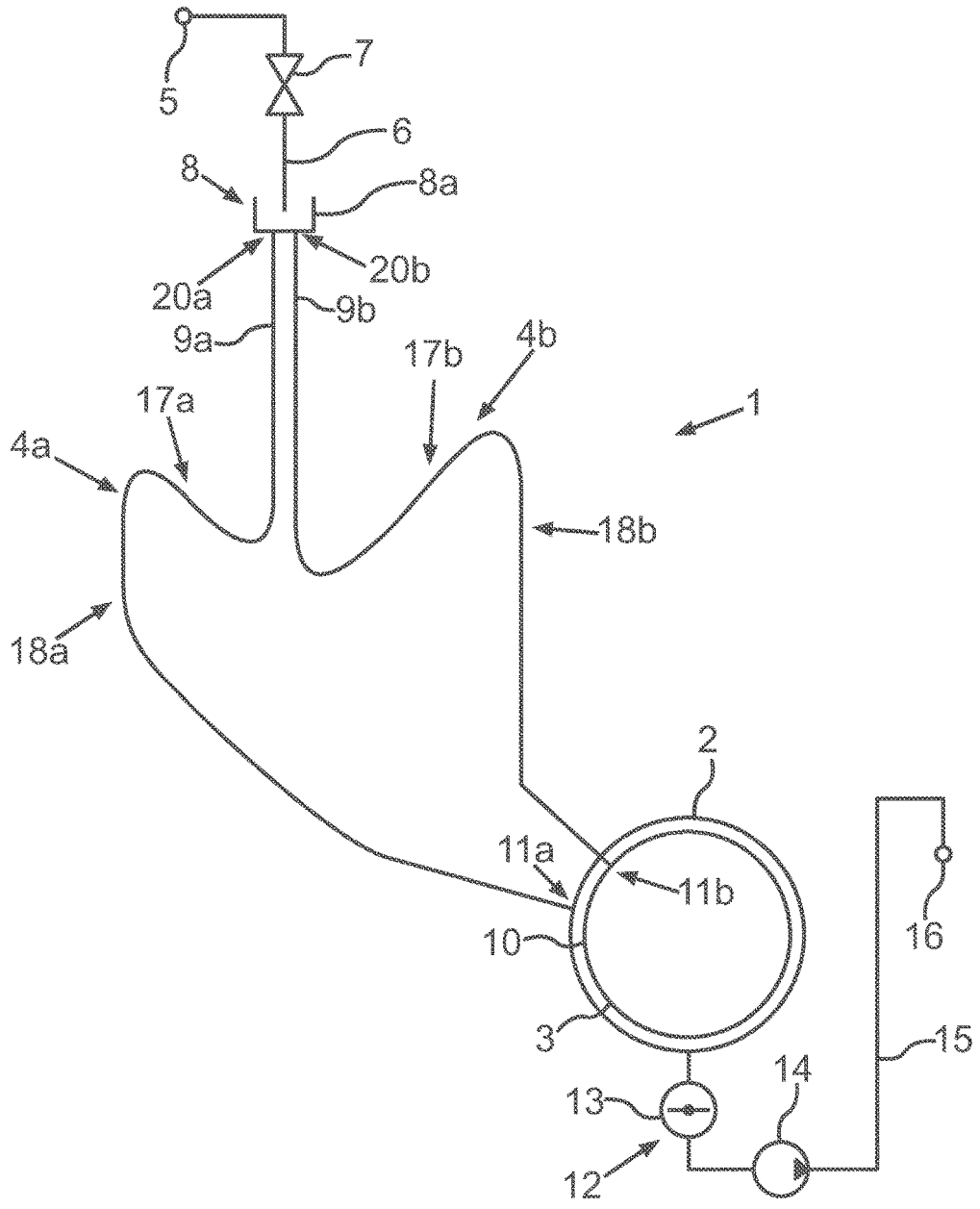
FIG. 1 shows a schematic representation of an exemplary embodiment of a household appliance according to the invention.

The household appliance 1 comprises a suds container 2 in which a drum 3 is arranged for receiving the laundry items and can be rotated about an axis of rotation standing vertical to the plane of the figure.

In addition, the household appliance 1 comprises a first supply duct 4*a* via which the fresh water is fed into the drum 3. There is also a connection 5 which can be connected to a household installation or the like. From the connection 5, a fresh-water line 6 runs into the interior of the household appliance 1. Arranged in the fresh-water line 6, there is a non-return valve 7, which is actuated, for example, by a controller in accordance with a program sequence. The fresh-water line 6 runs via a free air gap into a dispensing tray 8*a* of a dispensing arrangement 8. It is possible, for example, for a laundry treatment means, in particular a detergent, to be provided in the dispensing tray 8*a*, said laundry treatment means being flushed with the fresh water through a line 9*a* of the supply duct 4*a*.

The household appliance 1 comprises a flexible collar 10 which is connected to the suds container 2.

As can be identified from the representation in FIG. 1, the first supply duct 4*a* opens via a first inlet point 11*a* into the suds container 2. A pipe section of the supply duct 4*a* opens into the suds container 2 at this inlet point 11*a*. Hence, fresh water, and optionally a mixture of fresh water and a water-treatment means, can also be fed into the drum 3 via the supply duct 4*a*.

The household appliance 1 also comprises an outlet pump line 12 comprising a hinged cover 13, a suds pump 14 and a line 15. When the hinged cover 13 is open, suds provided in the suds container 2 can be pumped via the line 15 to an outlet 16 by actuating the suds pump 14. Here, the outlet 16 can be connected to a suitable outflow of a household installation or the like.

A vapor barrier device 17*a* is formed in the supply duct 4*a*. Said vapor barrier device is formed in a curved line section 18*a* of the supply duct 4*a*. The vapor barrier device 17*a* is formed by a water reservoir device.

As the representation in FIG. 1 also shows, the supply duct 4*a* opens into the suds container 2 at the inlet point 11*a*, wherein, on the other hand, the dispensing tray 8*a* of the dispensing arrangement 8 opens into the opening 20*a*.

In addition, in the exemplary embodiment, a second supply duct 4*b* is provided, which also comprises a line section 18*b* in which a curved upper section is formed. A vapor barrier device 17*b* is also embodied here. A connection is formed between the dispensing tray 8*a* and the further supply duct 4*b* via the line 9*b* via a further opening 20*b* into the dispensing tray 8*a*. On the other hand, the further supply duct 4*b* opens at an inlet point 11*b* into the collar 10, which is located between the suds container 2 and the drum 3.

It is provided in the exemplary embodiment that the supply duct 4*b* is formed without a specific ventilating channel, such as is provided with the supply duct 4*a*.

The line section 18*a* will be explained in more detail with reference to the following figures.

Figure 2:
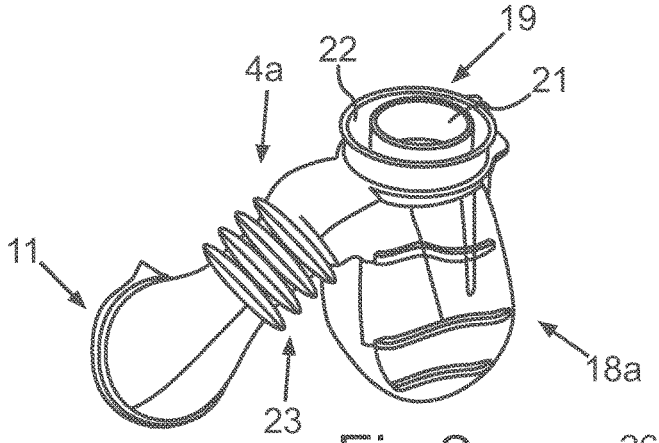
FIG. 2 shows a perspective representation of a supply duct of a household appliance according to FIG. 1.

To this end, FIG. 2 shows a perspective representation of the supply duct 4*a* with the line section 18*a*. The line section 18*a* comprises a first upper end 19 which is connected to a connecting branch 20 of the dispensing tray 8*a*. A supply channel 21 and, separated from this, a ventilating channel 22 opens into this upper first end 19. At this first end 19, for connection with continuations, these two channels 21 and 22 open thereinto and in addition are also formed separately from each other.

The line section 18*a*, which, in the exemplary embodiment, represents the supply duct 4*a*, is a one-pieced injection-molded part. It is predominantly rigid and only comprises a flexible channel section 23 in a central section, which is formed as a corrugated tube.

Figure 3:
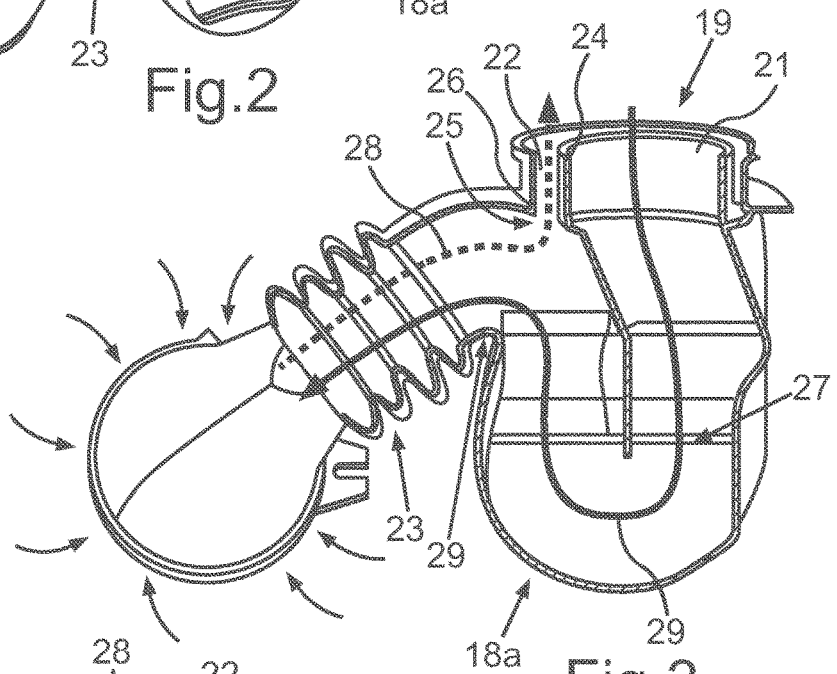
FIG. 3 shows a sectional representation through the embodiment according to FIG. 2.

FIG. 3 is a view, partially shown as a sectional representation, of the line section 18*a* according to FIG. 2. As can be identified from the representation in FIGS. 2 to 4, at this first end 19, the ventilating channel 22 does not completely encircle the supply channel 21 but in this regard only encircles it in some regions. The ventilating channel 22 is separated from the supply channel 21 by a partition wall 24.

As can be identified from the representation in FIG. 3, with respect to the height, the first end 19 is an upper end when considered with respect to levels.

The lower end 25 of the ventilating channel 22, which is facing away from the upper end 19, opens into curved supply channel 21.

An opening point 26 in this respect is formed at a higher level than a liquid level 27 in the supply channel 21. The embodiment of a partition wall 24 and the liquid level 27, which extends over the lower end of the partition wall 24, forms the vapor barrier. With respect to the level, the level of this liquid level 27 lies below the opening point 26. Hence, the removal of the process air 28, which is represented by the corresponding arrow, into the dispensing tray 8*a* can take place without problems via the supply duct 4*a* and the ventilating channel 22. On the other hand, the liquid medium 29 in the form of the fresh water and an optionally added detergent can be conveyed in accordance with the arrow direction shown from the dispensing tray 8*a* via the line section 18*a* formed as a curved pipe section as far as the inlet point 11*a*.

As may also be identified from FIG. 3, the flexible channel section 23 is formed in the supply channel 21 and hence arranged after the opening point 26 of the ventilating channel 22. As can also be identified from FIG. 3, when considered with respect to levels, the opening point 26 is also arranged above a buckled region 32 of the supply channel 21, wherein this buckled region 32 is subsequently arranged on the bend of the supply channel 21, in which bend the vapor barrier is formed. Even if the liquid were to splash over this buckled region 32 or the liquid level 27 were to rise up to this buckled point 32, problem-free ventilation process over the ventilating channel 22 is still possible. As already mentioned, this ventilating channel 22 then opens into a ventilating channel, not shown in any further detail, in the dispensing tray 8*a*, wherein there the air vent channel is routed such that it comes into contact with a partition wall bounding the volume area containing the liquid medium. This causes the process air to be guided along a condensation region as long as possible and then from this back toward the front in order in particular then to be able to exit from the front side of the dispensing tray 8*a*.

Figure 4:
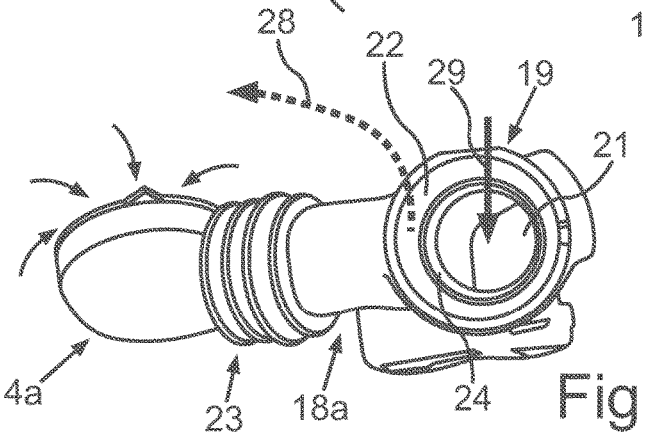
FIG. 4 shows a perspective top representation of the embodiment according to FIG. 2 and FIG. 3.

In FIG. 4, the upper first end 19 can be identified in a perspective representation. The outlet or aperture region of the ventilating channel 22 depicted in this representation as an annual section can be identified.

Figure 5:
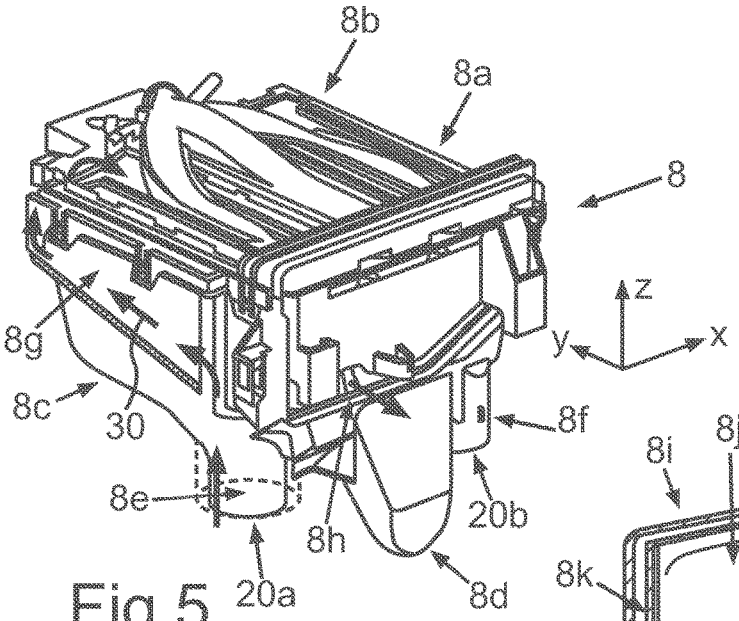
FIG. 5 shows a perspective representation of an exemplary embodiment of a dispensing arrangement with a dispensing tray.

FIG. 5 shows an exemplary embodiment of the dispensing arrangement 8 with the dispensing tray 8*a* in a perspective representation.

The dispensing tray 8*a* comprises an upper part 8*b* and a lower part 8*c*, which are produced as separate parts, for example as one-piece injection-molded parts and can be connected to each other, for example by latching.

A water-inlet mechanism 8*d* with a water-receiving trough is formed in the in the lower part 8*c* of the dispensing tray 8*a*. In the present exemplary embodiment according to the representation in FIG. 7, which shows a sectional representation in the x-z plane, the water-receiving trough is a siphon.

An outlet branch 8*e*, to which the line section 18*a* can be connected via the line 9*a*, is formed on the lower part 8*c*.

The line section 18*b* can then be connected via the line 9*b* to a further outlet branch 8*f*, which is integrated in lower part 8*c*.

As can be further identified from the representation in FIG. 5, an air vent channel 8*g* is formed in the outlet branch 8*e* and in further continuation, wherein here the representation is shown as partially broken open so that it is possible to look into the interior of the channel 8*g*. When the line section 18*a* is connected to the outlet branch 8*e*, the air is fed via the ventilating channel 22 according to the arrow direction 30 shown into the air vent channel 8*g* in the dispensing tray 8*a*. This air is then fed back from a front end of the dispensing tray 8*a*, on which the outlet branch 8*e* is formed, over the entire depth (y direction) and from there back to the front again and blown out of the dispensing tray 8*a* via a front aperture 8*h*.

Figure 6:
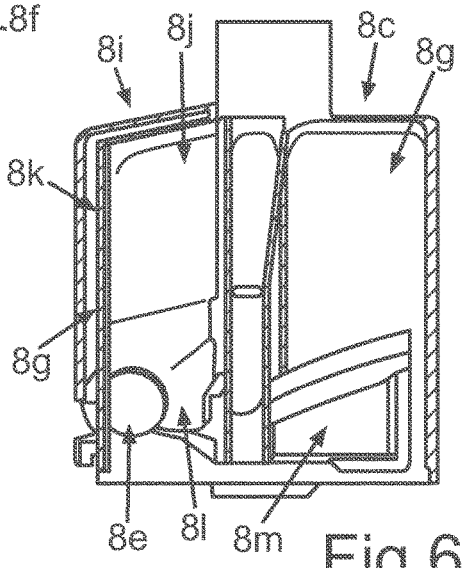
FIG. 6 shows a horizontal section representation through the embodiment according to FIG. 5.

It can be identified in the representation according to FIG. 6 that the very narrow air vent channel 8*g* is bounded on the inside by a partition wall 8*i*. This wall 8*i* is also simultaneously the partition wall of a water-receiving chamber 8*j* in the lower part 8*c*. The water located therein, which optionally also comprises a detergent, is then guided via the supply channel 21 to the suds container 2.

The quite specifically constructed and arranged air vent channel 8*g* causes the air to be conducted for as long as possible in the region of the water-receiving chamber 8*j* exposed to the liquid so that suitable condensation can take place.

The embodiment of the dispensing tray 8*a* is in addition provided such that a partial channel 8*k*, which, with a further partial channel in the upper part 8*b*, forms the closed entire air vent channel 8*g*, is formed in the lower part 8*c*.

It is also provided that the upper part 8*b* comprises a guide wall (not shown) by means of which, when the upper part 8*b* is assembled with the lower part 8*c*, an inner chamber of the dispensing tray 8*a* is divided into two dispensing channels 8*l* and 8*m*. A first dispensing channel 8*m* is formed with the water-inlet mechanism as a vapor barrier. A second dispensing channel 8*l* is formed with a water-inlet mechanism as a connection to the suds container 3.

Figure 7:
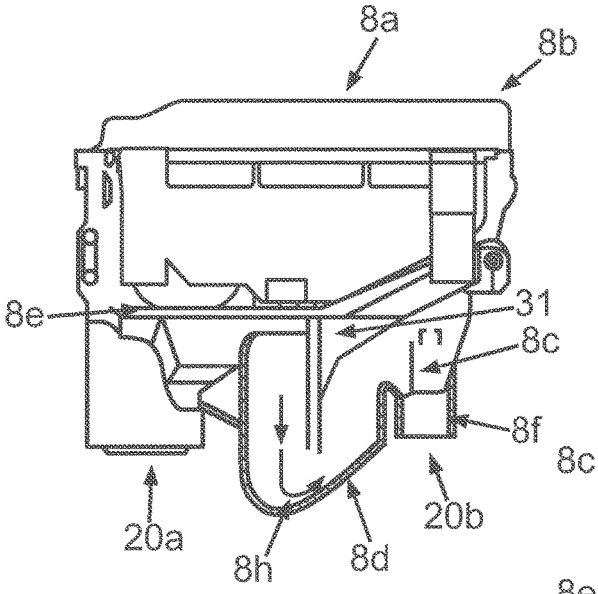
FIG. 7 shows a vertical sectional representation through the embodiment according to FIG. 5.

The already discussed representation in FIG. 7 shows the embodiment of the water-inlet mechanism 8*d* formed as a siphon 8*n* and represented as broken open. This is integrated in the lower part 8*c*.

To simplify the production of the lower part 8*c* as a one-piece injection-molded part, it is initially provided that only the water trough is formed. To create the siphon, a partition wall 31 is then produced and provided as a one-piece separate component, which can then be inserted into the lower part 8*c* in the region of the water trough and in particular can be positioned there by latching. To this end, FIG. 7 shows the in situ final state of this partition wall 31, which then results in the siphon-like embodiment of the water trough of the water-inlet mechanism 8*d*, and shows the flow path of the liquid medium according to the arrows shown in FIG. 7.

Figure 8:
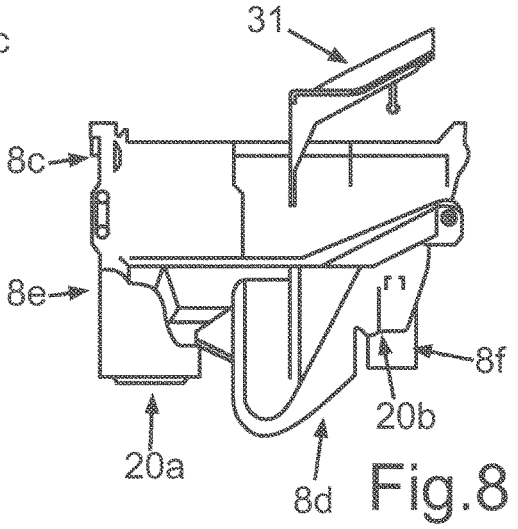
FIG. 8 shows a further representation of the embodiment in FIG. 7.

To this end, FIG. 8 shows a side view, in which the partition wall 31 has been removed. With an embodiment of this kind of the dispensing tray 8*a*, a quite specific water-reservoir system for the dispensing is formed, which, for process reliability, prevents vapor from escaping from the suds container 3 during the washing and drying processes. This takes place via the water reservoir in the integrated siphon 8*n* in the dispensing tray 8*a*.

If water runs out of the dispensing tray 8*a* to the collar between the suds container 2 and the drum 3, said water-reservoir system is fully flooded. During this, water flows through the channel.

A dispensing arrangement for a household appliance for the care of laundry items according to the invention comprises a dispensing tray, which comprises an upper part and a lower part that may be connected thereto, wherein a water-inlet mechanism with a water-receiving trough is formed in the lower part and a outlet branch is formed at the lower part, which opens into the water-receiving trough. The lower part comprises a partial channel of an air vent channel integrated in the dispensing tray opening into the outlet branch. An embodiment of the dispensing tray of this kind enables the achievement of a highly integrated system of a vapor barrier on the one hand and suitable ventilation on the other hand.

It is preferably provided that the partial channel is bounded by a wall, which is also a partition wall of a water-receiving chamber of the dispensing tray. This favors a compact embodiment. However, this in particular achieves a variant which should be particularly highlighted with respect to the condensation of the gaseous medium guided via the air vent channel.

It is preferably provided that the partial channel is substantially formed over the entire length of a water-receiving chamber of the dispensing tray in the lower part.

It is in particular provided that the partial channel is closed by a second partial channel in the upper part when the lower part is connected to the upper part.

It is in particular provided that the air vent channel from a front end of the lower part, on which the outlet branch is arranged, is guided to a rear end of the lower part and upward into the upper part and from there back to the front end opening into an outlet aperture. This achieves a particularly long path in the dispensing tray for the gas flow, which is in particular guided along a particularly long path to the water-receiving chamber. This particularly favors the desired condensation.

It is preferably provided that a partition wall separate from the lower part is formed, which can be attached to the lower part, and, in arranged state of the partition wall, a siphon is formed between the outlet branch and the water-receiving trough.

It is preferably provided that the upper part comprises a guide wall which, when the upper part is assembled with the lower part, divides the inner chamber of the dispensing tray into two dispensing channels.

It is in particular provided that a first dispensing channel is formed with the water-inlet mechanism as a vapor barrier.

Preferably, a second dispensing channel is formed with the water-inlet mechanism as a connection to a suds container of the household appliance.

The invention also relates to a household appliance for the care of laundry items, in particular a washing machine or a washer drier, which comprises a dispensing arrangement according to the invention or an advantageous embodiment thereof.

A dispensing arrangement for a household appliance for the care of laundry items according to the invention comprises a dispensing tray comprising an upper part and a lower part that can be connected thereto, wherein in the lower part a water-inlet mechanism with a water-receiving trough is formed, and an outlet branch is formed on the lower part, which into the water-receiving trough. A partition wall separate from the lower part is formed that can be attached to the lower part and, in the arranged state of the partition wall, a siphon is formed between the outlet branch and the water-receiving trough. An embodiment of this kind makes the production of the lower part in one piece simpler and more cost effective. Particularly with production as an injection-molded part, the embodiment and shaping of a siphon is extremely difficult and error prone. The fact that the partition wall is so-to-speak produced and provided independently and as a separate component and is only later arranged and is capable of being removed as a non-destructive detachable component eliminates these problems with production, while, on the other hand, the desired embodiment of a siphon is achieved.

It is particularly advantageous for it to be possible to attach the partition wall to the lower part by means of latching. This enables very quick and positionally accurate assembly, wherein then it is also possible for the partition wall to be simply removed again.

| List of reference numbers | |
|---|---|
| 1 | Household appliance |
| 2 | Suds container |
| 3 | Drum |
| 4a | Supply duct |
| 4b | Supply duct |
| 5 | Connection |
| 6 | Fresh-water line |
| 7 | Non-return valve |
| 8 | Dispensing arrangement |
| 8a | Dispensing tray |
| 8b | Upper part |
| 8c | Lower part |
| 8d | Water-inlet mechanism |
| 8e | Outlet branch |
| 8f | Outlet branch |
| 8g | Air vent channel |
| 8h | Aperture |
| 8i | Partition wall |
| 8j | Water-receiving chamber |
| 8k | Partial channel |
| 8l | Dispensing channel |
| 8m | Dispensing channel |
| 8n | Siphon |
| 9a | Line |
| 9b | Line |
| 10 | Collar |
| 11a | Inlet point |
| 11b | Inlet point |
| 12 | Outlet pump line |
| 13 | Hinged cover |
| 14 | Suds pump |
| 15 | Line |
| 16 | Outlet |
| 17a | Vapor barrier device |
| 17b | Vapor barrier device |
| 18a | Line section |
| 18b | Line section |
| 19 | First upper end |
| 20a | Opening |
| 20b | Opening |
| 21 | Supply channel |
| 22 | Ventilating channel |
| 23 | Channel section |
| 24 | Partition wall |
| 25 | Lower end |
| 26 | Opening point |
| 27 | Liquid level |
| 28 | Process air |
| 29 | Medium |
| 30 | Arrow direction |
| 31 | Partition wall |
| 32 | Buckled region |

The invention claimed is:

1. A household appliance for the care of laundry items, with a dispensing tray and a laundry container, which is connected to the dispensing tray via at least one supply duct, wherein a water trap vapor barrier is formed in a curved line section in the supply duct, the line section having a first end connected to the dispensing tray and a second end connected to the laundry container, wherein a ventilating channel is formed in the line section and has a ventilating outlet at the first end and connected to the dispensing tray and a ventilation channel inlet that is spaced from the ventilating outlet, wherein a partition wall located at least partially within the supply duct separates the ventilating channel at the first end from a supply channel that comprises the water trap vapor barrier for supplying liquid medium from the dispensing tray to the laundry container via the water trap vapor barrier, wherein, in use, if process air enters the line section from the laundry container, the process air is inhibited from passing through the water trap vapor barrier and is instead channeled into the ventilating channel, thus venting the process air away from the supply channel, and wherein the ventilating channel and the partition wall terminate at the first end.

2. The household appliance as claimed in claim 1, wherein the first end is an upper end.

3. The household appliance as claimed in claim 1, wherein the ventilating channel is formed so as to at least partially encircle the supply channel at the first end.

4. The household appliance as claimed in claim 1, wherein a lower end of the ventilating channel opens into the supply channel at an opening point, wherein the opening point lies above a liquid level forming the water trap vapor barrier in the supply channel.

5. The household appliance as claimed in claim 1, wherein, downstream of an opening of the ventilating channel, the supply channel comprises a flexible channel section.

6. The household appliance as claimed in claim 5, wherein the flexible channel section is formed of a corrugated tube.

7. The household appliance as claimed in claim 1, wherein the supply duct is formed as a one-piece line section.

8. The household appliance as claimed in claim 7, wherein the one-piece line section comprises an injection molded part.

9. The household appliance as claimed in claim 1, wherein the household appliance is a washing machine or a washer dryer.

10. The household appliance as claimed in claim 1, wherein the dispensing tray includes an air vent channel in communication with the ventilating channel.

11. The household appliance as claimed in claim 10, wherein the air vent channel is formed on an exterior surface of the dispensing tray.

12. The household appliance as claimed in claim 1, wherein the supply duct includes a mixing line section that extends from the second end of the supply duct to the water trap vapor barrier of the supply duct, wherein the mixing line section is configured to accommodate a mixture of the process air and the liquid medium simultaneously, and wherein the partition wall separates the process air from the liquid medium as the process air moves from the second end of the supply duct to the first end of the supply duct.

13. The household appliance as claimed in claim 1, wherein the supply duct includes only a single connection to the dispensing tray for both the liquid medium and the process air and only a single connection to the laundry container for both the liquid medium and the process air.

14. A supply duct for connecting a laundry container of a household laundry washing machine or washer/dryer to a detergent dispensing tray, the supply duct comprising:

a line section having a curved portion with a water trap vapor barrier device and a water/detergent supply channel to receive liquid medium from the dispensing tray, the line section having a first end adapted to be connected to the dispensing tray and a second end adapted to be connected to the laundry container;

a ventilating channel formed in the line section, the ventilating channel having an inlet spaced from the first end of the line section, wherein, in use, if process air enters the line section from the laundry container, the process air is inhibited from passing through the water trap vapor barrier device and is instead channeled into the ventilating channel, thus venting the process air away from the water/detergent supply channel;

a partition wall extending to the first end to separate the ventilating channel from the water/detergent supply channel; and wherein the ventilating channel and the partition wall terminate at the first end.

15. The supply duct as claimed in claim 14, wherein the first end is an upper end.

16. The supply duct as claimed in claim 14, wherein the ventilating channel is formed so as to at least partially encircle the supply channel at the first end.

17. The supply duct as claimed in claim 14, wherein a lower end of the ventilating channel opens into the supply channel at an opening point, wherein the opening point lies above a liquid level forming the water trap vapor barrier device in the supply channel.

18. The supply duct as claimed in claim 14, wherein, downstream of an opening of the ventilating channel, the supply channel comprises a flexible channel section.

19. The supply duct as claimed in claim 18, wherein the flexible channel section is formed of a corrugated tube.

20. The supply duct as claimed in claim 14, wherein the supply duct is formed as a one-piece line section.

21. The supply duct as claimed in claim 20, wherein the one-piece line section comprises an injection molded part.

22. A household laundry washing machine or washer/dryer comprising the laundry container, the detergent dispensing tray and the supply duct of claim 14.

* * * * *